US005170642A

United States Patent [19]

Sakata

[11] Patent Number: 5,170,642

[45] Date of Patent: Dec. 15, 1992

[54] EAR PIERCING EARRING

[75] Inventor: Kentaro Sakata, Tokyo, Japan

[73] Assignee: Universe Yamaki Co., Ltd., Tokyo, Japan

[21] Appl. No.: 657,901

[22] Filed: Feb. 20, 1991

[30] Foreign Application Priority Data

Feb. 21, 1990 [JP] Japan ..... 2-38443

[51] Int. Cl.[5] ..... A44C 7/00

[52] U.S. Cl. ..... 63/12

[58] Field of Search ..... 63/12, 13, 1.1, 2

[56] References Cited

U.S. PATENT DOCUMENTS

| | | | |
|---|---|---|---|
| 2,568,207 | 9/1951 | Spicher | 63/12 X |
| 2,642,872 | 6/1953 | Parker | 63/12 X |
| 3,789,850 | 2/1974 | Ford | 63/12 X |

FOREIGN PATENT DOCUMENTS

| | | | |
|---|---|---|---|
| 47888 | of 1889 | Fed. Rep. of Germany | 63/12 |
| 98330 | of 1898 | Fed. Rep. of Germany . | |
| 1542918 | 3/1979 | United Kingdom | 63/12 |
| 2118822 | 11/1983 | United Kingdom | 63/12 |
| 2187960 | 9/1987 | United Kingdom | 63/13 |

*Primary Examiner*—Renee S. Luebke
*Assistant Examiner*—Jerry Redman
*Attorney, Agent, or Firm*—Blum Kaplan

[57] ABSTRACT

A reusable ear piercing earring includes a piercing pin with a circumferential groove formed therein. The groove is positioned between a pointed end of said piercing pin and a proximate end of said piercing pin. A distal end portion of the piercing pin including the pointed end is adapted to be broken off from the proximate end of the piercing pin at the groove. The circumferential groove is formed into a substantially V-shaped cross-section wherein one surface of the circumferential groove on the same side as the pointed end is inclined at an inclination angle $\theta$ of about $20° \pm 10°$ with respect to a plane perpendicular to the axis of the piercing pin. The other surface of the groove opposite to the one surface is arcuate or round. The earring is first inserted through the ear. To reuse the earring the distal end portion of the piercing pin is separated from the proximate end of the piercing pin at the groove to provide a piercing pin with a new distal end. This new distal end is then inserted into the earlobe.

11 Claims, 1 Drawing Sheet

EAR PIERCING EARRING

BACKGROUND OF THE INVENTION

The invention relates to an ear piercing earring for decorating ears of women, and more particularly to a method of reusing an ear piercing earring and an ear piercing earring suitable for reuse.

In general, an ear piercing earring is conventionally constructed so that a piercing pin is inserted through a throughhole formed at an earlobe and is securely engaged with a clutch, called a catcher, to mount the ear piercing earring on the earlobe. Once the conventional ear piercing earring of such construction is used, it is generally discarded because it is not suitable for reuse. Nevertheless, when it is to be forcibly reused, the piercing pin is reinserted through the original through-hole of the earlobe without modifying the piercing pin of the ear piercing earring.

Unfortunately, the reuse of the ear piercing earring in such a manner as described above causes a user to suffer a great deal of pain and/or inconvenience during the earring remounting operation. Thus, the user is unwilling to reuse the ear piercing earring. This results in the manufacturing of an ear piercing earring of a low cost being utilized because an ear piercing earring which has high quality and exhibits a decorative value of a high level is not readily accepted by the user because of the public's reluctance to reuse the prior art ear piercing earring. Accordingly, an ear piercing earring which is adapted for reuse is desired.

SUMMARY OF THE INVENTION

Generally speaking in accordance with the present invention, an ear piercing earring suitable for reuse is provided. The ear piercing earring includes a piercing pin having a distal end portion provided with a pointed end. A depression is formed within the piercing pin. The ear piercing earring also includes a clutch held on the piercing pin by the depression. A circumferential groove is formed about the circumference of the piercing pin and is positioned between the pointed end and the depression. The distal end portion of the piercing pin is adapted to be broken off from the piercing pin at the circumferential groove to provide the piercing pin with an exposed second distal end. The circumferential groove is formed into a substantially V-shape cross-section wherein one surface of the circumferential groove on the side of the pointed end is inclined at an inclination angle $\theta$ of about $20° \pm 10°$ with respect to a plane substantially perpendicular to the axis of the piercing pin and the opposed surface of the circumferential groove opposite to the first surface is arcuate.

In accordance with one aspect of the present invention, a method of reusing the ear piercing earring including a clutch and a piercing pin which has a distal end portion provided with a pointed end, the piercing pin being formed with a groove of a predetermined depth in a manner to be positioned between the pointed end and the depression is provided. The method includes the steps of breaking off the distal end portion of the piercing pin from a proximate end of the piercing pin at the groove providing the piercing pin with an exposed second distal end. The proximate end of the piercing pin now is inserted through an earlobe for the reusing of the ear piercing earring.

In the ear piercing earring of the present invention constructed as described above, the distal end portion of the piercing pin is broken off from the proximate end of the piercing pin at the circumferential groove when it is to be reused, so that the piercing pin of the ear piercing earring may be readily inserted at the newly exposed end of the proximate end through an earlobe of a user. Also, the configuration of the circumferential groove described above facilitates the breaking-off of the distal end portion of the piercing pin and prevents a user from suffering pain when the piercing pin is re-inserted through a hole previously formed at an earlobe of the user, because the piercing pin contacts the earlobe at the arcuate or round surface of the exposed end of the piercing pin.

In an exemplary embodiment of the present invention, the circumferential groove is formed over the overall circumference of the piercing pin. Such construction of the circumferential groove facilitates the breaking-off of the distal end portion of the piercing pin and prevents the exposed end from having any burrs, so that the reusing of the ear piercing earring may be conveniently carried out. The rounded surface of the circumferential groove has a radius of 0.3 mm. In the preferred embodiment of the present invention, the circumferential groove has a diameter d substantially equal to about one fourth the diameter D of the piercing pin and the depression has a diameter D' somewhat larger than half of diameter D of the piercing pin. The diameters D, D' and d may be 0.8 mm, 0.5 mm and 0.2 mm, respectively. A distance L between the depression and the pointed end is 3.5 mm and a distance L' between the center of the circumferential groove and the pointed end is 0.2 mm.

Accordingly, it is an object of the present invention to provide a method for reusing an ear piercing earring which is capable of permitting a user to safely and comfortably reuse an ear piercing earring.

It is another object of the present invention to provide a method for reusing an ear piercing earring which is capable of facilitating the reusing of an ear piercing earring.

It is a further object of the present invention to provide a method for reusing an ear piercing earring, the steps of which can be readily and simply carried out for initial use and reuse.

It is still a further object of the present invention to provide an ear piercing earring which is capable of facilitating its reuse while ensuring the safety and comfort of a user during the reuse operation.

Still other objects and advantages of the invention will in part, be obvious and will, in part, be apparent from the specification.

The invention accordingly comprises the several steps and the relation of one or more of such steps with respect to each of the others, and the apparatus embodying features of construction, combination of elements, and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENT

Figure 1:
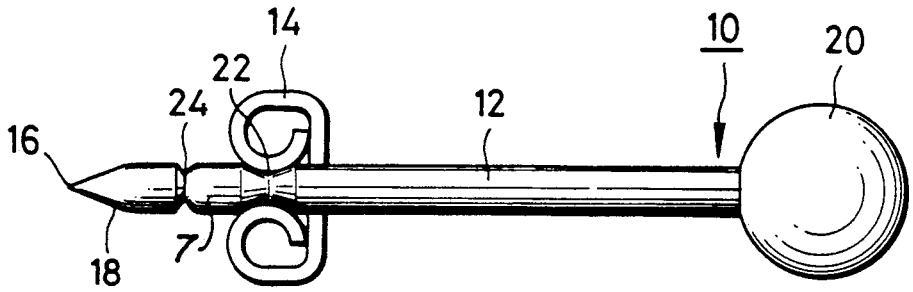
FIG. 1 is a side elevation view of an ear piercing earring constructed in accordance with the present invention.

Reference is now made to FIG. 1 wherein an ear piercing earring generally designated by reference numeral 10 and constructed in accordance with a preferred embodiment of the invention is provided. Ear piercing earring 10 generally includes a piercing pin 12 and a clutch 14 often called a catcher. Piercing pin 12 has a proximate end portion 7 and a distal end portion 18. Distal end portion 18 includes a pointed end 16. Proximal end portion 7 is provided with a decorative element 20. A circumferentially extending depression 22 is formed on piercing pin 12 to selectively securely retain a clutch 14.

Figure 2:
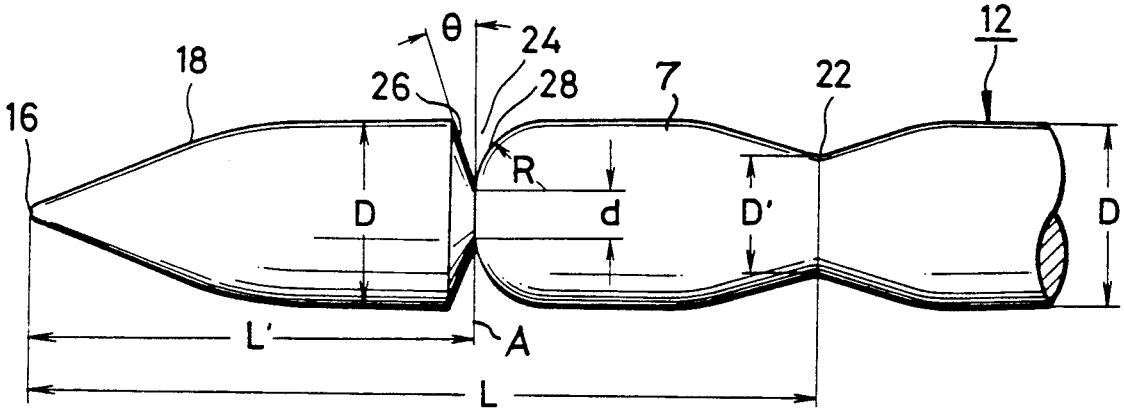
FIG. 2 is a fragmentary enlarged side elevation view of the distal portion of the ear piercing earring.

A circumferentially extending groove 24 of a predetermined depth is disposed within piercing pin 12 between pointed end 16 and depression 22 so that the piercing pin 12 may be broken at the circumferential groove 24 to remove the pointed end 16 when the piercing earring 10 is to be reused. Circumferential groove 24 for breaking off or removing the distal end portion 18 is preferably arranged so as to extend over the overall circumference of the piercing pin 12. Also, the circumferential groove 24, as shown in FIG. 2, is preferably formed into a substantially V shape in cross-section wherein an inner surface 26 of the groove 24 on the side of the pointed end 16 is preferably inclined at an inclination angle $\theta$ of about $20° \pm 10°$ with respect to a plane A perpendicular to the axis of the piercing pin 12 and an inner surface 28 of the groove 24 opposite to the surface 26 is formed into an arcuate or round shape. Such configuration of the circumferential groove 24 in the illustrated embodiment causes a diameter d of the groove 24 to be decreased to substantially one fourth the diameter D of the piercing pin 12. When the inclination angle is more than 30 degrees, the groove 24 adversely affects the strength of the piercing pin 12, whereas an inclination angle of less than 10 degrees fails to conveniently carry out the breaking-off of the distal end portion 18. Also, in an exemplary embodiment, the depression 22 has a diameter D' somewhat larger than half of the diameter D of the piercing pin 12. The diameters D, D' and d can be, but are not limited to, about 0.8 mm, 0.5 mm and 0.2 mm, respectively.

The exemplary embodiment may be constructed in such a manner that a distance L between the depression 22 and the pointed end 16 of the distal end portion 18 is 3.5 mm and the distance L' between the center of the circumferential groove 24 and the pointed end 16 is 2.0 mm.

Figure 3:
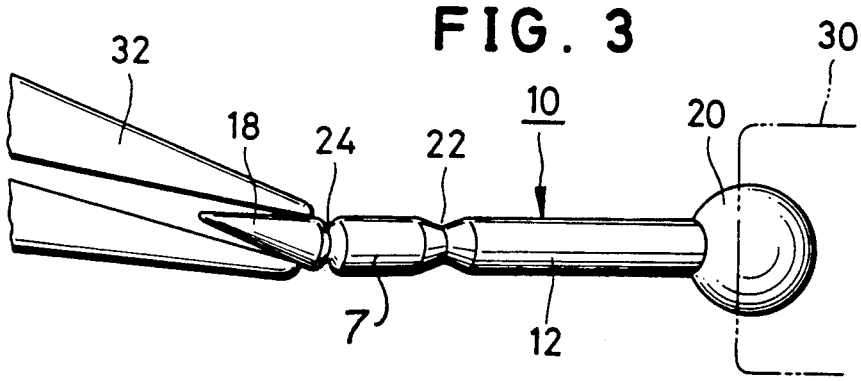
FIG. 3 is a perspective view showing the breaking off of the distal end portion of a piercing pin in accordance with the invention.
Figure 4:
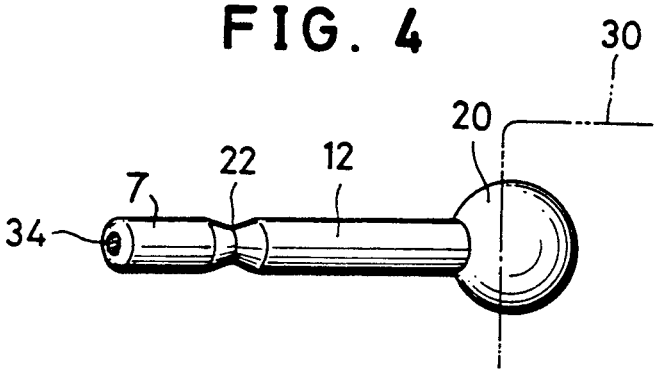
FIG. 4 is a perspective view showing the piercing pin constructed in accordance with the invention in which the distal end portion is broken off.

As shown in FIG. 3, the distal end portion 18 of the piercing pin 12 of ear piercing earring 10 which is fixed through the decorative element 20 on a fixing means 30 is subject to a breaking-off operation using a suitable means 32 such as cutting pliers or the like. This causes the distal end portion 18 to be broken off at the circumferential groove 24 from the piercing pin 12, resulting in the proximate end 7 piercing pin 12 having an exposed second distal end 34 of a round shape, as shown in FIG. 4. For this purpose, in the illustrated embodiment, the radius R of the second distal end 34 is about 0.3 mm.

The above-described dimensions D, D', d, L, L' and R are by way of example and may be varied depending upon a material of the ear piercing earring or piercing pin and the like.

As can be seen from the foregoing, the ear piercing earring of the present invention is so constructed that the piercing pin 12 is formed with the circumferential groove 24 of a predetermined depth positioned between the depression 22 of the ear piercing pin 10 and the pointed end 16 of the distal end portion 18, resulting in the distal end portion 18 being adapted to be broken off at the groove 24 from the piercing pin 12. Such construction of the present invention permits the distal end portion 18 to be removed or broken off at the groove 24 from the piercing pin 12 when the piercing earring is to be reused, so that the reusing of the piercing earring may be conveniently and readily accomplished because the insertion of the piercing pin through an earlobe for the reuse is carried out at the exposed distal end 34 which has a round shape. Also, the circumferential groove 24 is positioned between the depression 22 for holding the clutch 14 therethrough on the piercing pin 12 and the pointed end 16. Such arrangement of the groove 24 ensures positive holding of the clutch 14 on the depression 22, because the depression 22 still remains on the piercing pin 12 even after the distal end portion 18 is removed from the piercing pin 12.

Also, in the present invention, the circumferential groove 24 may be arranged over the overall circumference of the piercing pin 12. Such arrangement of the groove 24 effectively prevents the exposed distal end 34 from being formed at the periphery thereof with burrs, to thereby permit the insertion of the piercing pin through an earlobe of a user for the purpose of reusing the piercing earring to be carried out with safety and comfort.

Further, the present invention is constructed so that the circumferential groove 24 is formed into a substantially V-shape in cross-section wherein the surface 26 of the groove 24 on the side of the pointed end 16 is inclined at an inclination angle $\theta$ of about $20° \pm 10°$ with respect to a plane perpendicular to the axis of the piercing pin 12 and the surface 28 of the groove 24 opposite to the surface 26 is arcuate or round. Such configuration of the circumferential groove 24 facilitates the breaking-off of the distal end portion 18 and contributes to the formation of the exposed distal end 34 of a round shape, resulting in the handling of the piercing pin and the insertion of the pin through an earlobe for the reuse of the piercing earring being readily and conveniently carried out.

For initial use of the ear piercing earring 10, the ear piercing pin 12 including pointed end 16 is inserted through the earlobe to form the hole. To reuse the ear piercing earring 10, the distal end portion 18 of piercing pin 12 is broken off from proximate end 7 of piercing pin 10 at the circumferential groove 24. Piercing pin 10 is then reinserted through the previously formed hole of the earlobe. The radiused portion of the newly formed distal end portion 34 allows for the comfortable reinsertion of piercing pin 12.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ear piercing earring to be worn on an ear, comprising:

piercing means coupled to said decorative portion for piercing said ear and for securing said earring to said ear, said piercing means having a proximate portion, a first distal end portion a pointed end formed on said first distal end portion, depression means for retaining a clutch thereon and a circumferential groove extending about the complete periphery of said piercing means and positioned between said depression means and said first distal end portion;

wherein upon application of a breaking force to said first distal end portion, said first distal end portion separates from said proximate portion at said circumferential groove forming a second distal end portion at said circumferential groove.

2. The ear piercing earring of claim 1, wherein said depression means is separated from said pointed end by a distance L, said distance L being about 3.5 mm and the center of said circumferential groove being separated from said pointed end by a distance of L', L' being about 2.0 mm.

3. An ear piercing earring to be worn on an ear, comprising:

a decorative portion; and piercing means coupled to said decorative portion for piercing said ear and for securing said earring to said ear, said piercing means having a proximate portion, a first distal end portion depression means for selectively retaining a clutch thereon and a circumferential groove extending about the complete periphery of said piercing means said circumferential groove being disposed between said depression means and said first distal end portion;

wherein upon application of a breaking force to said first distal end portion, said first distal end portion separates from said proximate portion at said circumferential groove forming a second distal end portion at said circumferential groove.

4. The ear piercing earring as defined in claim 3, wherein said arcuate second inner surface of said circumferential groove has a radius of 0.3 mm.

5. The ear piercing earring of claim 3, wherein said piercing means extends along an axis between said decorative portion and said piercing means, said circumferential groove having a substantially V-shaped cross-section, said groove having a first inner surface and a second inner surface, said first inner surface being adjacent said first distal end portion, said first inner surface being inclined at an inclination angle 8 within a range of about 10° to 30° with respect to a plane perpendicular to the axis of said piercing means and the second inner surface of said circumferential groove is arcuate.

6. The ear piercing earring as defined in claim 5, wherein said piercing means near said circumferential groove has a diameter D said circumferential groove has a diameter d which is equal to about $\frac{1}{4}$ the diameter D of said piercing means.

7. The ear piercing earring as defined in claim 6, wherein said diameter D is 0.8 mm.

8. The ear piercing earring as defined in claim 6, wherein said diameter d is 0.2 mm.

9. The ear piercing earring of claim 3, wherein said distal portion includes a pointed end and a distance L between said depression means and said pointed end is about 3.5 mm and a distance of L' between the center of said circumferential groove and said pointed end is about 2.0 mm.

10. The ear piercing earring as defined in claim 9, wherein the diameter D' is 0.5 mm.

11. The ear piercing earring as defined in claim 3, wherein said piercing means near said circumferential groove has a diameter D and said depression means has a diameter D' dimensioned to be greater than one half the diameter D of said piercing means.

* * * * *